United States Patent [19]

Hatzis

[11] 4,447,148

[45] May 8, 1984

[54] EDGE PRINTING DEVICE

[75] Inventor: Van Hatzis, Trumbull, Conn.

[73] Assignee: Pitney Bowes Inc., Stamford, Conn.

[21] Appl. No.: 418,362

[22] Filed: Sep. 15, 1982

[51] Int. Cl.[3] ..... G03G 15/00

[52] U.S. Cl. ..... 355/75; 355/3 R; 355/3 SH; 355/112; 346/107 A; 346/107 B; 346/107 C; 400/716; 430/31

[58] Field of Search ..... 355/3 R, 16, 112, 133, 355/75, 3 SH, 50, 51, 76, 11; 346/107 A, 107 B, 107 C; 400/716

[56] References Cited

U.S. PATENT DOCUMENTS

| | | | |
|---|---|---|---|
| 2,482,621 | 9/1949 | Jones | 346/107 B |
| 2,566,204 | 8/1951 | Hughey | 355/112 |
| 2,641,523 | 6/1953 | Beckman et al. | 346/107 B |
| 2,646,334 | 7/1953 | Marchand | 346/107 B |
| 3,111,887 | 11/1963 | Alexander | 346/107 C |
| 3,642,370 | 2/1972 | Meredith et al. | 355/75 |
| 3,689,155 | 9/1972 | Nishiyama et al. | 346/107 C |
| 3,775,007 | 11/1973 | Davidson | 355/75 X |
| 4,037,956 | 7/1977 | McKeen | 346/107 C |

FOREIGN PATENT DOCUMENTS

| | | | |
|---|---|---|---|
| 2611001 | 9/1977 | Fed. Rep. of Germany | 355/112 |

*Primary Examiner*—Richard L. Moses

*Attorney, Agent, or Firm*—Martin D. Wittstein; William D. Soltow, Jr.; Albert W. Scribner

[57] ABSTRACT

An Edge Printing Device is utilized adjacent to the exposure station of a document reproducing apparatus having an auxiliary document handling apparatus mounted over the exposure station. The documents, moving over the exposure station drive a friction roller which in turn rotates an indicia roller so that supplemental information thereon is copied simultaneously with the image on the moving document. The supplemental information is produced on an edge portion of the copy sheet, in an area beyond the lateral dimensions on the copy sheet.

5 Claims, 3 Drawing Figures

EDGE PRINTING DEVICE

BACKGROUND OF THE INVENTION

1. Field of the Invention

This invention relates to an Edge Printing Device for printing supplemental information along the edge of a copy sheet produced in a document reproducing apparatus. Specifically, the invention is comprised of a friction roller assembly including a driven indicia roller having printable material on a replacable flexible strip which is attached to the driven roller. The document being reproduced causes the friction roller to rotate, which in turn rotates the indicia roller.

The friction and indicia roller assembly is mounted on a support arranged over the document exposure station. Each original document fed from an automatic document feeder apparatus positively rotates the friction and indicia roller assembly. The document material being reproduced is typically comprised of physicians' or dentists' statements, or the like, which are 5½ inches in width. These documents are generally sent out as bills for services rendered on a monthly basis and it is advantageous to provide printed coded accounting material on the documents at the time of billing. For example, a serial number, and a date is helpful in the office accounting system for keeping track of the billing, and is easily printed on one lateral edge of a copy sheet which is 8½ or 11 inches wide.

The document feeder is able to accommodate the narrow 5½ inch wide statements since the feeder side frames are typically adjustable in a lateral dimension to accommodate different widths of such documents.

Accordingly, the present invention takes advantage of this difference in the lateral width of original document statement material with respect to the copy sheet.

2. Prior Art

U.S. Pat. No. 3,775,007, issued to Davidson, Nov. 27, 1973, discloses an imprinter for use with a copying machine. The imprinter has means to provide variable information on the copies generated from the machine.

While this imprinter is used with a copier, it must be restricted to use with that type of copier where the original document remains stationary during the exposure process. Moreover, it is not readily apparent as to how to utilize the intended device without having to project the object illumination system through the original document in order to copy the desired information of the imprinter.

It is desired to directly illuminate such information, and have it printed on the lateral edge of the copy sheet. The present invention accomplishes this, with a minimum of parts, and a clear, unobstructed optical path with respect to the information to be copied.

SUMMARY OF THE INVENTION

An edge printing device is provided on a document reproducing apparatus having a document exposure station with a predetermined lateral dimension and means for moving the document past the exposure station. The printing device prints supplemental information along the edge of a copy sheet on which a document with a smaller lateral dimension than the predetermined lateral exposure station dimension has been reproduced upon.

The printing device is mounted within a support mounted on the document reproducing apparatus which extends across the document exposure station.

The device consists of an indicia roller and friction roller assembly rotatably mounted on the support in a lateral position beyond the longitudinal edge of a document with a smaller lateral dimension than the copy sheet. The friction roller is rotated during engagement with the moving document which engages the friction roller at an intermediate lateral location of the support.

The friction roller rotates together with the indicia roller while the moving document drives the friction roller and the supplemental information carried upon the indicia roller is copied simultaneously with the image on the document in an edge portion of the copy sheet beyond the limits of the document image on the copy sheet.

OBJECTS OF THE INVENTION

It is an object of the present invention to provide a simple and convenient means for the operator of a reproducing machine to print supplemental information on copy sheets.

This and other objects and advantages of the present invention will become more apparent from details disclosed in the following specification where a preferred embodiment of the invention is disclosed.

DESCRIPTION OF A PREFERRED EMBODIMENT OF THE INVENTION

Figure 1:
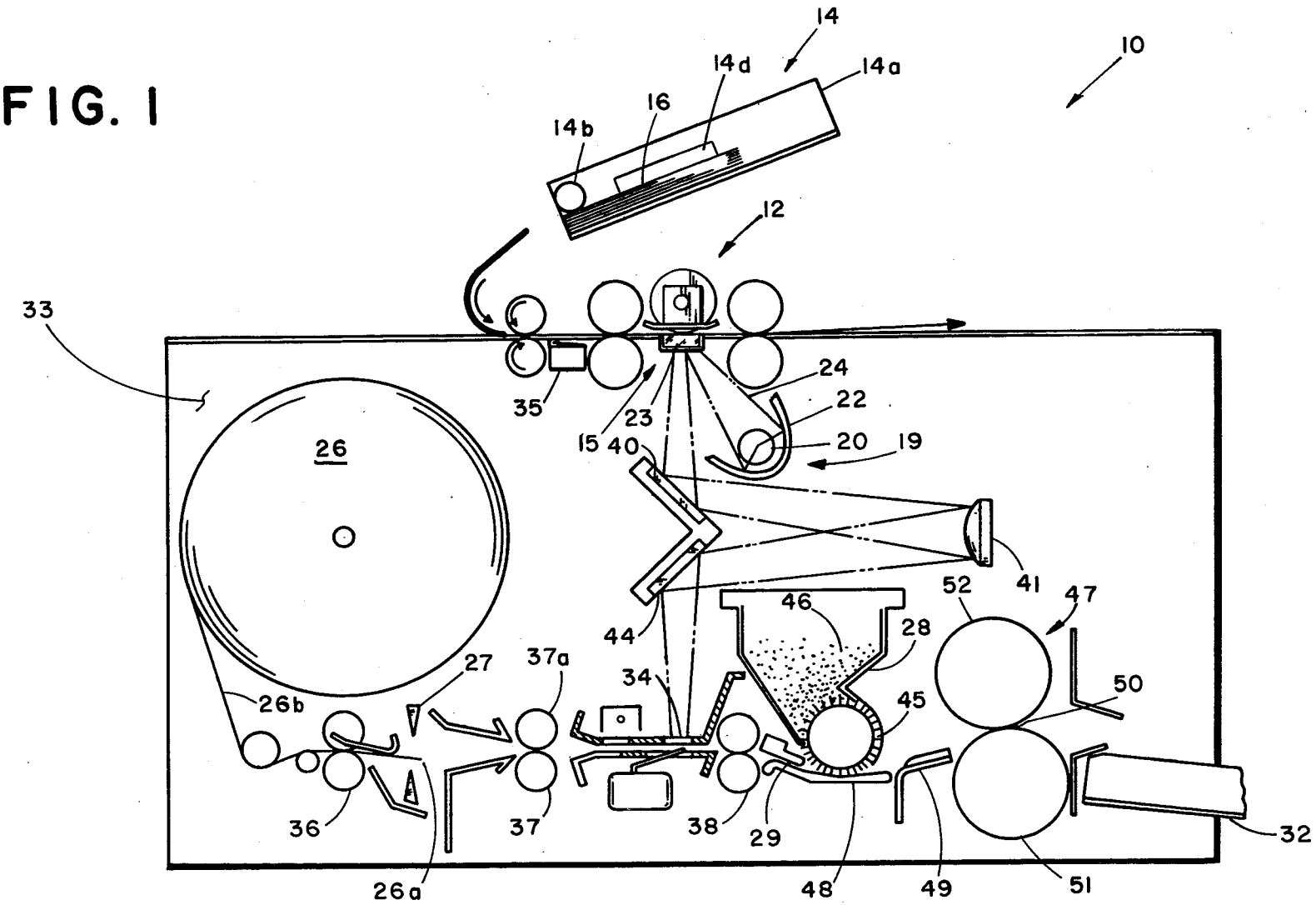
FIG. 1 represents an uncovered front view of a reproducing machine having a document feeder mounted over the exposure station.

Referring now to the drawings, and particularly to FIG. 1, there is illustrated a reproducing copying machine 10, on which the present invention comprising an edge printing device 12 is utilized. There is provided a suitable document feeding apparatus 14 which is attached to the top of the copier 10, by appropriate fastening devices (not shown). The documents are placed face up, in the document feed hopper 14*a*, and are fed one at a time by appropriate timed sequencing devices, associated with separator roller 14*b*. The feeder 14 is located so that it overlies the exposure station 15 of the copier 10 for operator convenience. The feeder 14 feeds documents singly from a document stack 16, in order that each document is positively fed across the exposure station 15. This feed function is repeated, sequentially until all remaining documents in the stack 16 have been fed from the feed hopper 14*a*.

An illumination system 19, including an exposure lamp 20, and cooperating reflector 22 provide high intensity illumination directed at the exposure station 15 through the document platen glass 23. The illumination rays 24 travel through the document platen glass 23 which supports the documents traveling over the exposure station 15 during the exposure portion of the copying process.

The copier 10 in the present specification is described as the type which utilizes photoconductor paper stored in a roll 26 and which constitutes the image receptor and copy paper sheet when cut by the knife assembly 27 after each exposure of an original document of a particular length. A dry developing unit 28 is provided along the path of travel 29 of the copy sheet, where each exposed image of an original is developed prior to delivery to the machine operator at an output tray 32.

The roll of photoconductive copy paper 26 is stored within the framework 33 of copier 10 and is fed forward toward the image reception station 34 when the lead edge of a document trips a switch 35. The leading end 26*a* of the copy paper is advanced along its path of travel 29 by pairs of paper feeding rollers 36, 37 and 38 toward the image reception station 34, and further to the developing unit 28. The rollers 36, 37 and 38 are rotatably engaged at the proper time by electromagnetic clutches (not shown), which provide a matching lineal speed for the copy paper 26 in order to match the lineal speed of each original document fed over the exposure station 15, and the document platen glass 23.

The copy sheet feeding rollers 36, 37 and 38 are rotatably engaged and driven from connections made with a main power source (not shown), through energization of electromagnetic 24 VDC clutches which are (not shown) connectively engaged to each separate pair of rollers 36, 37 and 38. The clutches are electrically engaged at a point in time, in respect to the machine cycle so that the copy sheet is forwarded through the copier's processing path 29 in corresponding time with the original document sensed by switch 35 just prior to being copied at the exposure station 15.

The illuminated image on an original document at the exposure station 15 is reflected through mirror 40, lens 41, and mirror 44, directly onto the copy sheet 26 which is previously sensitized at the roller pair 37 by charging roller 37*a* through an electrical method. The sensitizing charge enables the photoconductive coating side 26*b* of the copy paper to receive the optically transmitted image of each original document for subsequent development by the dry developing unit 28. A developer applicator roller 45 provides a uniform flow of dry developing material 46 which is attracted to the sensitized copy sheet passing beneath the roller 45 so that the exposed image is developed. Subsequent to development, the copy sheet with an unfused image is guided towards a fixing unit 47, by suitable sheet guide members 48 and 49, which lead to the pressure nip 50 of the fixing rollers 51 and 52. A stacker output tray 32 receives the finished fused copy sheets as they exit the fixing unit 47.

The original document feeder apparatus 14 has formed, laterally adjusted upright side plates 14*d* which are capable of lateral sidewise adjustment in order to accommodate variations in the width or lateral position of the original documents 16 in the feeder hopper 14*a*. The whole feeder 14 is also capable of being adjusted laterally with respect to the lateral position of the copy paper 26 located between frames 33. The feeder 14 may be adjusted and positioned to the front or rear sides 33 of the reproducing machine 10. This accomodates any necessity to position the documents in that a clear, marginal, image-free edge of copy sheet 26*b* may be produced.

Figure 2:
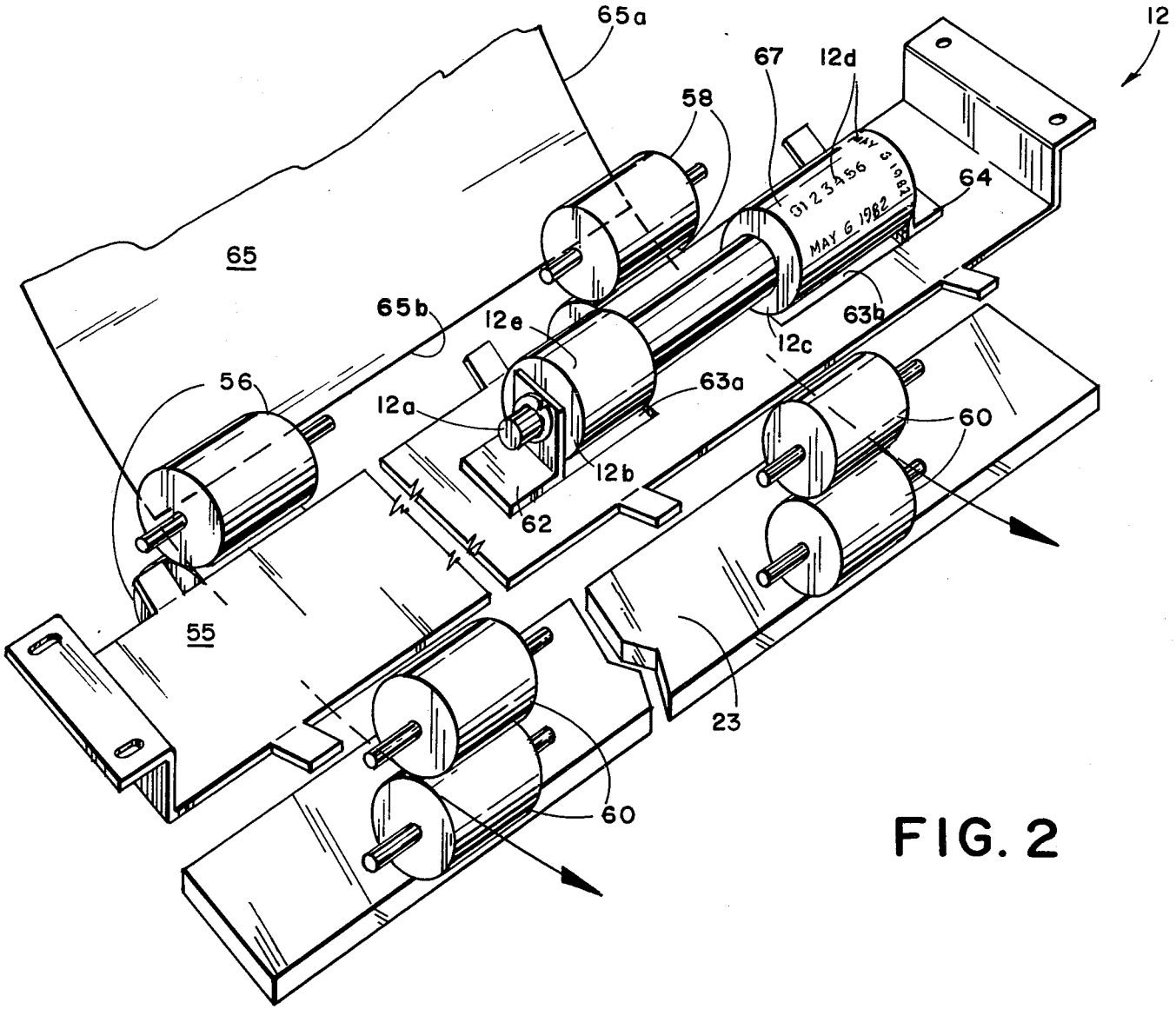
FIG. 2 represents a partial, top isometric view of the printing device and its mounting to the support.

Referring to FIG. 2, the Edge Printing Device 12 is seen in more detail. The platen glass 23 is shown beneath a support 55 which additionally serves as an upper document guide, attached to machine members (not shown) on the front and rear sides of the top of the machine framework 33. Separate driven pairs of document transport rollers 56, 58 and 60 serve to positively drive each separated document fed from stack 16 across the platen glass 23, under the document guide support member 55. The transport rollers 56, 58 and 60 are all rotatively supported appropriately in the machine framework 33, and are driven by means (not shown) connected to the main drive of the machine. The transport rollers 56, 58 and 60 are continuously driven, since it is not necessary to start and stop these rollers in addition to the document separator roller 14*b*, which, in combination with document sensing switch 35 controls the sequence of events necessary to execute the reproducing machine 10 functions in sequence, and in response to the separated individual documents being fed.

The support 55 has upright tabs 62 and 64 which are appropriately fastened to the support 55 in order to freely rotatably support the printing device 12. The printing device 12 is comprised of an aluminum shaft 12*a*, over which an elastomer friction sleeve 12*b*, and indicia sleeve 12*c* are pressed to form an assembly. The support 55 has cut outs 63 in the form of accomodating apertures 63*a* and 63*b* which friction sleeve 12*b* and indicia sleeve 12*c* respectively project down through in order to align the peripheral surface of sleeve 12*c* with the lineal paper path of documents moving across the top of the glass platen 23.

When an original document, represented by document 65 is positively transported across platen 23, by the roller pairs 56, 58 and 60, the friction sleeve 12*b* is engaged by the document 65 thereby rotating shaft 12*a* and sleeve 12*c*. It is seen in FIG. 2, that the edge 65*a* of document 65 is located laterally away from indicia sleeve 12*c*, so that the lead edge 65*b* of the document 65 engages the sleeve 12*b*, but not the indicia sleeve 12*c*, thereby giving the optical illuminating system 19 of the machine 10 a clear view of the supplemental information 12*d* carried by sleeve 12*c*. Supplemental information 12*d* carried upon the periphery of indicia sleeve 12*c* is optically transmitted to the image receiving station 34 in the same manner as an image upon document 65. The indicia sleeve 12*c* is formed from suitable material such as a tube of plastic, or may be comprised of a larger diameter of the aluminum shaft 12*a*. It is desirable to keep the printing device 12 as light in weight as possible, to enable the thinnest of original documents to rotate the edge printing device 12 to ensure rotation of the printing device 12 during document transport across the platen 23. It is possible that the shaft 12*a* is manufactured entirely of plastic, and has only a friction portion 12*b* formed from a suitable elastomeric sleeve material which is pushed over shaft 12*a*, to provide the friction surface 12*e*, which is engaged by the moving original documents. It is also possible to provide a shaft 12*a*, which is totally manufactured of plastic having a roughened localized surface such as a diamond knurl, which is capable of being rotated by the moving documents, thereby eliminating the need for assembly of an elastomer sleeve 12*b* over shaft 12*a*.

An example of supplemental information 12*d* is illustrated in FIG. 2, as it is pre-printed, stamped or written on suitable separate strip pressure sensitive label material 67, which is pressed circumferentially over the periphery of indicia sleeve 12*c*. The machine operator merely has to press the strip shaped label onto the periphery of roller 12*c*, while slowly spinning the shaft 12*a*.

Figure 3:
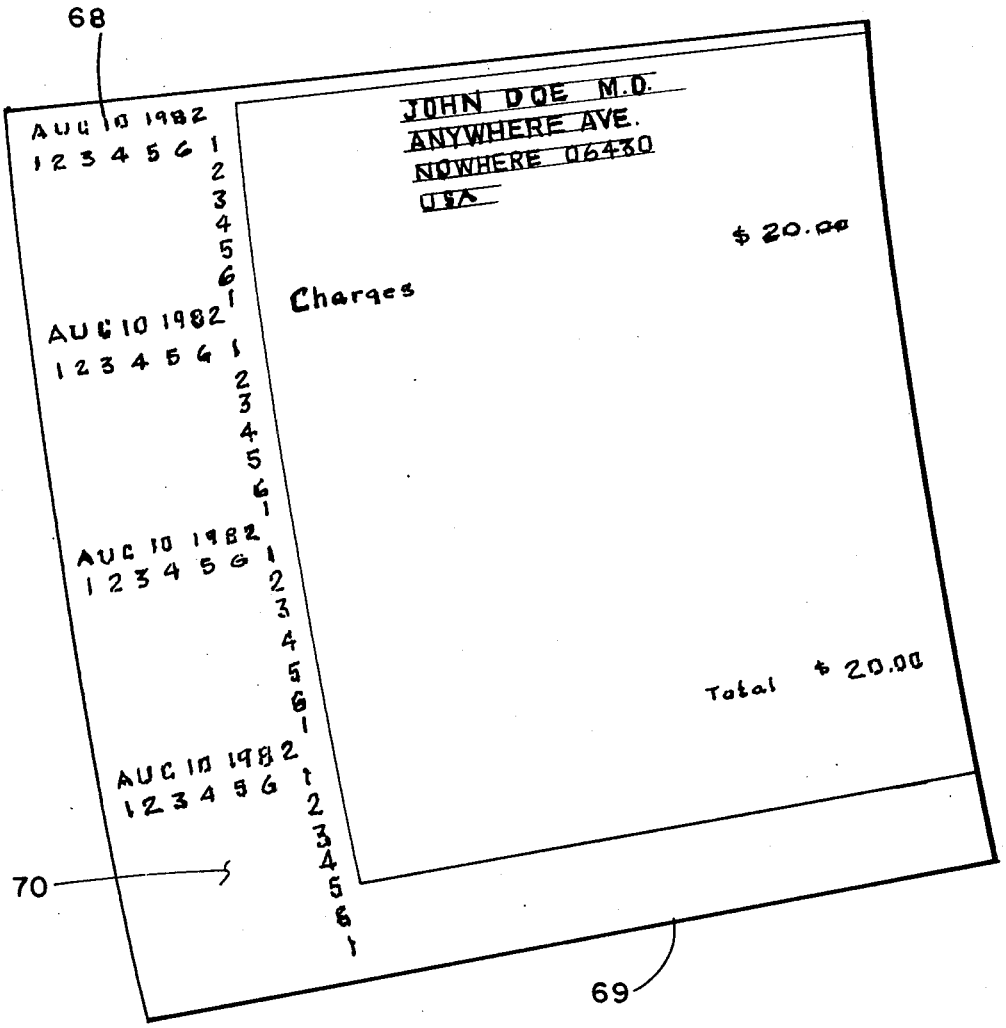
FIG. 3 represents a copy sheet having a reproduced document and supplemental information printed on an edge portion.

A further example of what the supplemental information 12*d* looks like when printed on the copy sheet is illustrated in FIG. 3. A date and number 68 is repeatedly provided as copied on the copy sheet 69 from the edge printer 12 and is oriented in any desired direction along the edge 70, of the copy sheet. There is latitude to adjust the lateral position of the imaged copy of the statement 72, with respect to the supplemental information 68 printed, through lateral adjustment of the document feeder 14, or the side plates 14*d* as previously described within the present specification.

Having described and illustrated an embodiment of the present invention, it will be apparent that various modifications and alterations may be made thereto. It is therefore intended that the scope of the present invention shall be limited only as defined in the following claims.

What is claimed is:

1. An edge printing device for use on a document reproducing apparatus which includes a document exposure station having a predetermined lateral dimension and means for moving the document past the exposure station, said device printing supplemental information along the edge of a copy sheet on which a document having a smaller lateral dimension than said predetermined lateral dimension has been reproduced, said device comprising:

A. support means mounted on said document reproducing apparatus and extending across said document exposure station, B. an indicia roller rotatably mounted on said support means adjacent one end of said support means in a position to be beyond the longitudinal edge of a document which has a lateral dimension less than said predetermined lateral dimension, C. a friction roller rotatably mounted on said support means at an intermediate location along said support means such that said friction roller is in contact with a document as the document is moved past the exposure station of the reproducing apparatus, and D. means connecting said indicia to said friction roller for movement therewith, whereby the moving document drives said friction roller which in turn rotates said indicia roller so that the supplemental information thereon is copied simultaneously with the image on the document in an edge portion of the copy sheet which is beyond the lateral dimension of the image on the copy sheet.

2. An edge printing device according to claim 1 wherein the supplemental information on said indicia roller is printed on a flexible strip which is removably attached to the circumference of said roller.

3. An edge printing device according to claim 1 wherein the diameters of said friction roller and said indicia roller are substantially identical.

4. A friction and indicia roller as set forth in claim 1, and having an elastomeric drive portion for engagement with a document.

5. A friction and indicia roller as set forth in claim 2, being formed of one piece of plastic.

* * * * *